US010262779B2

(12) United States Patent
Shimizu

(10) Patent No.: US 10,262,779 B2
(45) Date of Patent: Apr. 16, 2019

(54) R-T-B-BASED MAGNET MATERIAL ALLOY AND METHOD FOR PRODUCING THE SAME

(71) Applicant: CHUO DENKI KOGYO CO., LTD., Tokyo (JP)

(72) Inventor: Takayuki Shimizu, Yachiyo (JP)

(73) Assignee: SANTOKU CORPORATION, Hyogo (JP)

( * ) Notice: Subject to any disclaimer, the term of this patent is extended or adjusted under 35 U.S.C. 154(b) by 644 days.

(21) Appl. No.: 14/773,485

(22) PCT Filed: Mar. 28, 2014

(86) PCT No.: PCT/JP2014/001817
§ 371 (c)(1),
(2) Date: Sep. 8, 2015

(87) PCT Pub. No.: WO2014/156181
PCT Pub. Date: Oct. 2, 2014

(65) Prior Publication Data

US 2016/0027563 A1 Jan. 28, 2016

(30) Foreign Application Priority Data

Mar. 29, 2013 (JP) ..... 2013-071353

(51) Int. Cl.
*H01F 1/057* (2006.01)
*B22F 9/04* (2006.01)
(Continued)

(52) U.S. Cl.
CPC ..... *H01F 1/0571* (2013.01); *B22F 9/04* (2013.01); *C22C 38/00* (2013.01); *C22C 38/002* (2013.01);
(Continued)

(58) Field of Classification Search
None
See application file for complete search history.

(56) References Cited

U.S. PATENT DOCUMENTS

2014/0132377 A1* 5/2014 Nakajima ..... B22F 3/24 335/302

FOREIGN PATENT DOCUMENTS

CN 1983471 6/2007
CN 101051544 10/2007
(Continued)

OTHER PUBLICATIONS

Machine translation of JPH08-269643, Oct. 1996. (Year: 1996).*

*Primary Examiner* — Xiaowei Su
(74) *Attorney, Agent, or Firm* — Clark & Brody

(57) ABSTRACT

Provided is an R-T-B-based magnet material alloy including an $R_2T_{14}B$ phase which is a principal phase and R-rich phases which are phases enriched with the R, wherein the principal phase has primary dendrite arms and secondary dendrite arms diverging from the primary dendrite arms, and regions where the secondary dendrite arms have been formed constitute a volume fraction of 2 to 60% of the alloy, whereby excellent coercive force can be ensured in R-T-B-based sintered magnets even when the amount of heavy rare earth elements added to the alloy is reduced. The inter-R-rich phase spacing is preferably at most 3.0 μm, and the volume fraction of chill crystals is preferably at most 1%. Furthermore, the secondary dendrite arm spacing is preferably 0.5 to 2.0 μm, and the ellipsoid aspect ratio of R-rich phase is preferably at most 0.5.

8 Claims, 2 Drawing Sheets

(51) Int. Cl.

| | |
|---|---|
| ***C22C 38/00*** | (2006.01) |
| ***C22C 38/06*** | (2006.01) |
| ***C22C 38/10*** | (2006.01) |
| ***C22C 38/16*** | (2006.01) |

(52) U.S. Cl.
CPC ..... *C22C 38/005* (2013.01); *C22C 38/06* (2013.01); *C22C 38/10* (2013.01); *C22C 38/16* (2013.01); *B22F 2998/10* (2013.01); *C22C 2202/02* (2013.01)

(56) References Cited

FOREIGN PATENT DOCUMENTS

| | | |
|---|---|---|
| JP | 08-269243 | 10/1996 |
| JP | 08-269643 A | 10/1996 |
| JP | 09-20954 | 1/1997 |
| JP | 2002-173744 | 6/2002 |
| JP | 2008-264875 | 11/2008 |
| JP | 4832856 | 9/2011 |
| WO | 2005/105343 | 11/2005 |
| WO | 2013/054854 | 4/2013 |

* cited by examiner

R-T-B-BASED MAGNET MATERIAL ALLOY AND METHOD FOR PRODUCING THE SAME

TECHNICAL FIELD

The present invention relates to an R-T-B-based magnet material alloy that is used as a material for rare earth magnets and a method for producing the same. In particular, the present invention relates to an R-T-B-based magnet material alloy capable of ensuring excellent coercive force in R-T-B-based sintered magnets even in the case where the amount of heavy rare earth elements added to the alloy is reduced, and the invention also relates to a method for producing such an alloy.

BACKGROUND ART

Among rare earth magnet material alloys which have been used in recent years are R-T-B-based alloys, which exhibit excellent magnetic properties. In the term "R-T-B-based alloys" as used herein, "R" refers to rare earth metals, "T" refers to transition metals with Fe being an essential element, and "B" refers to boron. An alloy, made of such an R-T-B-based alloy, which serves as a material for rare earth magnets can be produced from a ribbon cast by a strip casting method.

FIG. 1 is a schematic diagram of a casting apparatus that is used for casting of ribbons using a strip casting method. The casting apparatus shown in FIG. 1 is provided with a chamber 5, a crucible 1, a tundish 2, and a chill roll 3. The inside of the chamber 5 is maintained to be in a reduced pressure condition or an inert gas atmosphere, whereby oxidation of the molten alloy and the cast ribbon is prevented.

When a ribbon of an R-T-B-based alloy is cast by a strip casting method using such a casting apparatus, the following procedure, for example, may be employed.

(A) Raw materials are loaded into the crucible 1, and the raw materials are heated using an induction heating apparatus (not shown). Thus, the raw materials are melted to form a molten alloy.

(B) The molten alloy is supplied to the outer peripheral surface of the chill roll 3 via the tundish 2. The chill roll 3 is configured to have a coolant circulating therein, and therefore the molten alloy is rapidly cooled on the outer peripheral surface of the chill roll 3 to be solidified.

(C) In this manner, a thin ribbon 4 having a thickness of 0.1 to 1.0 mm is cast. The chill roll 3 rotates in the direction shown by the hatched arrow in FIG. 1 and accordingly the ribbon 4 separates from the chill roll 3.

The thin ribbon cast by a strip casting method is crushed into alloy flakes and then they are cooled under predetermined conditions. The crushing of the ribbon and the cooling of the alloy flakes are typically carried out under reduced pressure or in an inert gas atmosphere in order to prevent oxidation of the alloy flakes.

The resultant R-T-B-based magnet material alloy (hereinafter also simply referred to as "magnet material alloy") has a crystal structure in which a crystalline phase (principal phase) of $R_2T_{14}B$ phase and R-rich phases having concentrated rare earth metals coexist. The principal phase is a ferromagnetic phase that contributes to magnetization, and the R-rich phases are non-magnetic phases that do not contribute to magnetization.

An R-T-B-based magnet material alloy is also referred to as an Nd—Fe—B-based magnet material alloy because R is mainly composed of Nd and T is mainly composed of Fe. Magnet material alloys are widely used as materials for R-T-B-based sintered magnets and R-T-B-based bonded magnets, and of these, R-T-B-based sintered magnets are also referred to as neodymium sintered magnets.

R-T-B-based sintered magnets can be produced by the following production process, for example.

(1) In a pulverizing step, an R-T-B-based magnet material alloy is hydrogen decrepitated (coarsely pulverized) and then finely pulverized in a jet mill or the like. In this manner, a fine powder is obtained.

(2) In a forming step, the obtained fine powder is pressed in a magnetic field to be formed into a green body.

(3) In a sintering step, the pressed green body is sintered in a vacuum and then the sintered body is subjected to a heat treatment (tempering). In this manner, an R-T-B-based sintered magnet is produced.

The demand for neodymium sintered magnets has been increasing worldwide in view of environmental protection (realization of low-carbon society), energy conservation, and use in next generation automobiles, high performance electronic devices, and the like. However, one problem with neodymium sintered magnets is their low coercive force at elevated temperatures.

To solve this problem, a type of neodymium sintered magnet, made from a magnet material alloy to which heavy rare earth elements (e.g., Dy, Tb, etc.) have been added as a partial replacement for Nd, has been developed and put into practical use. The amount of heavy rare earth elements added thereto is, for example, about 1 to 5 atomic % in total.

However, heavy rare earth elements pose a problem with regard to steady supply because of the limited deposits and uneven distribution of the resources. Thus, there is a need for a magnet material alloy capable of ensuring excellent coercive force in neodymium sintered magnets even in the case where the amount of heavy rare earth elements added to the magnet material alloy is reduced, specifically, in the case where the amount of heavy rare earth elements added is about 0 to 3 atomic % in total, for example.

In the past, various proposals have been made on R-T-B-based magnet material alloys as disclosed, for example, in Patent Literature 1. In the magnet material alloy proposed in Patent Literature 1, the volume percentage of the region containing an $R_2T_{17}$ phase having an average grain diameter of 3 μm or less in the short axis direction is from 0.5 to 10%. It is stated therein that, by using the magnet material alloy as a material for sintered magnets, it is possible to provide the resultant sintered magnets with a stably increased coercive force and therefore excellent magnetic properties.

CITATION LIST

Patent Literature

Patent Literature 1: Japanese Patent No. 4832856

SUMMARY OF INVENTION

Technical Problem

As described above, there is a need for an R-T-B-based magnet material alloy capable of ensuring excellent coercive force in sintered magnets even in the case where the amount of heavy rare earth elements added to the alloy is reduced.

Patent Literature 1 as mentioned above discloses a magnet material alloy in which the volume percentage of the region containing an $R_2T_{17}$ phase having an average grain diameter of 3 μm or less in the short axis direction is from 0.5 to 10%. This makes it possible to provide the resultant sintered magnets with a stably increased coercive force and therefore excellent magnetic properties, according to the patent literature. However, when a magnet material alloy containing an $R_2T_{17}$ phase is heated, a liquid phase starts to form gradually at 685° C. or higher in the $R_2T_{17}$ phase, and thus the solid $R_2T_{17}$ phase and the liquid phase coexist until the temperature reaches 1210° C. Thus, at a sintering temperature (typically about 1050° C.) in the sintering step for producing a sintered magnet, part of the $R_2T_{17}$ phase remains without being transformed into the liquid phase, and as a result the $R_2T_{17}$ phase remains in the resultant sintered magnet.

The $R_2T_{17}$ phase is magnetically soft and has a low Curie temperature, and therefore the $R_2T_{17}$ phase, if it remains in the sintered magnet even in trace quantities, has adverse effects on the coercive force and heat resistance properties thereof. Therefore, the magnet material alloy proposed in Patent Literature 1 is not sufficient to meet the above-described need.

The present invention has been made in view of the above circumstances. Accordingly, an object of the present invention is to provide an R-T-B-based magnet material alloy capable of ensuring excellent coercive force in R-T-B-based sintered magnets even in the case where the amount of heavy rare earth elements added to the alloy is reduced, and also to provide a method for producing such an alloy.

Solution to Problem

In recent years, with the aim of reducing the amount of heavy rare earth elements to be added to an R-T-B-based magnet material alloy, extensive analysis has been undertaken on the mechanism by which magnetic properties are exhibited in R-T-B-based sintered magnets. One achievement of the analysis is the proposal of the following formula (2), which is a model expression for representing the coercive force Hc of an R-T-B-based sintered magnet.

$$Hc=\alpha\times Ha-Neff\times Ms \quad (2)$$

where α is a coefficient representing a decrease in the magnetic anisotropy due to defects near the grain boundaries, surface conditions or the like; Ha is an anisotropy field; Neff is a local demagnetizing factor depending on the size and shape of the grains; and Ms is a saturation magnetization of the principal phase.

The above formula (2) indicates that, for increasing the coercive force Hc, it is useful to add a heavy rare earth element so as to improve the anisotropy field Ha and reduce the saturation magnetization Ms of the principal phase. It is also useful to improve the coefficient α and to reduce the local demagnetizing factor Neff. More specifically, it is useful to refine the grain size to the size of a single domain particle and completely break exchange coupling between the grains so that the anisotropy field Ha can be improved and the local demagnetizing factor Neff can be reduced. It is also useful to elongate the shape of the grains along the axis of easy magnetization so that the local demagnetizing factor Neff can be reduced.

Here, it is noted that conventional magnet material alloys are formed so as to have an inter-R-rich phase spacing of at least about 3 μm as a target lower limit in view of limitations associated with the sintered magnet production process. The limitations associated with the sintered magnet production process are, specifically, limitations of pulverization capacity in the pulverizing step and limitations in handling the fine powder in the forming step (oxidation of the fine powder, forming failures, or the like). As used herein, the inter-R-rich phase spacing refers to a spacing between an R-rich phase and its adjacent R-rich phase in a cross section along the thickness direction of the magnet material alloy.

Recently, however, technological breakthroughs have been occurring for the pulverizing step and the forming step. Examples of the technological breakthroughs are pulverization techniques that enable pulverization into a fine powder with a particle size of not greater than 3 μm and forming techniques using a fine powder with a particle size of not greater than 3 μm. With such a pulverization technique and a forming technique, it is possible to produce sintered magnets while inhibiting oxidation of the fine powder, forming failures, and the like.

The present inventor conceived the idea of refining the microstructure of the magnet material alloy and in addition employing, in the sintered magnet production process, a pulverization technique that enables pulverization into a fine powder with a particle size of not greater than 3 μm and a forming technique that enables pressing of the fine powder with a particle size of not greater than 3 μm into a green body. He has found that this makes it possible to improve the anisotropy field Ha and reduce the local demagnetizing factor Neff of the resulting sintered magnet. He has found that, consequently, the coercive force Hc of the resulting sintered magnet can be improved. Furthermore, he has found that, by forming secondary dendrite arms in the ribbon when casting it from a molten alloy, refinement of the microstructure can be achieved and therefore the coercive force in the sintered magnet can be improved.

The present invention has been accomplished based on the above findings, and the summaries thereof are set forth below in the items (1) to (5) relating to an R-T-B-based magnet material alloy and the item (6) relating to a method for producing the R-T-B-based magnet material alloy.

(1) An R-T-B-based magnet material alloy where R is at least one element selected from rare earth metals including Y, and T is one or more transition metals with Fe being an essential element, the R-T-B-based magnet material alloy comprising an $R_2T_{14}B$ phase which is a principal phase and R-rich phases which are phases enriched with the R, the principal phase having primary dendrite arms and secondary dendrite arms diverging from the primary dendrite arms, regions where the secondary dendrite arms have been formed constituting a volume fraction of 2 to 60% of the alloy.

(2) The R-T-B-based magnet material alloy according to the above (1), wherein a spacing between adjacent R-rich phases is at most 3.0 μm.

(3) The R-T-B-based magnet material alloy according to the above (1) or (2), wherein chill crystals constitute a volume fraction of at most 1% of the alloy.

(4) The R-T-B-based magnet material alloy according to any one of the above (1) to (3), wherein a secondary dendrite arm spacing is 0.5 to 2.0 μm.

(5) The R-T-B-based magnet material alloy according to any one of the above (1) to (4), wherein the R-rich phases have an ellipsoid aspect ratio of at most 0.5.

(6) A method for producing an R-T-B-based magnet material alloy, comprising: casting a ribbon by supplying a molten R-T-B-based alloy (where R is at least one element selected from rare earth metals including Y, and T is one or more transition metals with Fe being an essential element) to an outer peripheral surface of a chill roll and solidifying the molten alloy; and crushing the ribbon, the casting of the ribbon being performed in such a manner that an average cooling rate on the chill roll is 2000 to 4500° C./second and a temperature $T_I$ (° C.) of the ribbon at a position where the ribbon separates from the chill roll satisfies the following formula (1), $$400 \leq T_M - T_I \leq 600 \quad (1)$$

where $T_M$ is a melting point (° C.) of the R-T-B-based alloy.

Advantageous Effects of Invention

An R-T-B-based magnet material alloy according to the present invention has a refined microstructure by virtue of secondary dendrite arms formed therein. Thus, when the alloy is used as a material for an R-T-B-based sintered magnet, it is possible to improve the coercive force because of the improved anisotropy field and the reduced local demagnetizing factor. Thus, even in the case where the amount of heavy rare earth elements added to the magnet material alloy is reduced, excellent coercive force can be ensured in R-T-B-based sintered magnets.

According to the method for producing an R-T-B-based magnet material alloy of the present invention, when casting a ribbon by solidifying a molten alloy on a chill roll, the casting is carried out in such a manner that the average cooling rate on the chill roll and the temperature of the ribbon at a position where it separates from the chill roll satisfy predetermined conditions. This enables formation of secondary dendrite arms, so that the above-described R-T-B-based magnet material alloy of the present invention can be obtained.

DESCRIPTION OF EMBODIMENTS

The following are descriptions of an R-T-B-based magnet material alloy according to the present invention and a method for producing the same.

1. R-T-B-Based Magnet Material Alloy of the Present Invention

Figure 2:
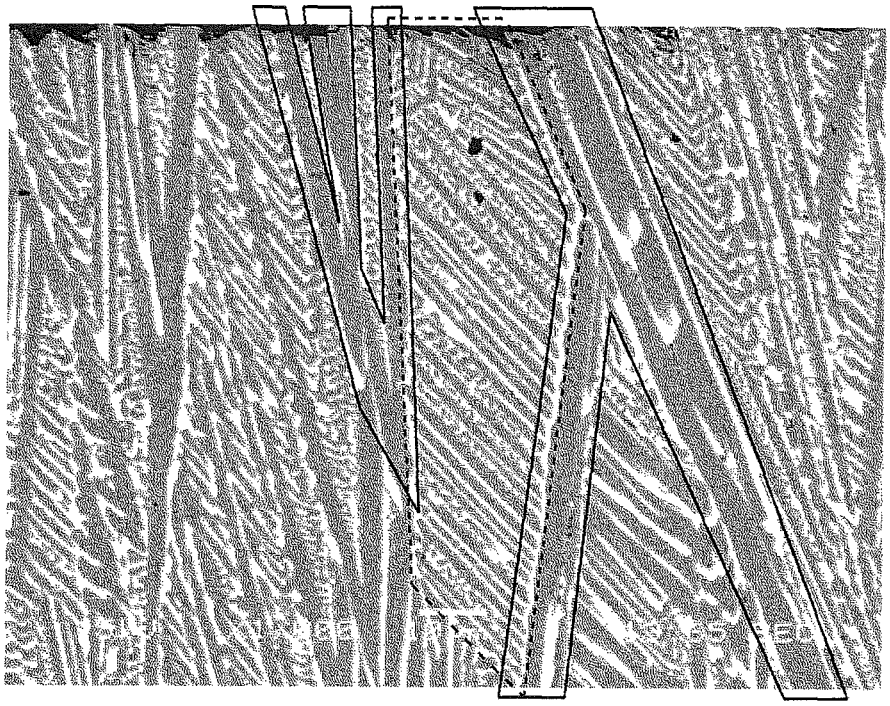
FIG. 2 is a photograph showing an example of a magnet material alloy according to the present invention.

FIG. 2 is a photograph showing an example of a magnet material alloy according to the present invention. FIG. 2 is a photograph of a cross section, in the thickness direction, of a magnet material alloy obtained in Inventive Example 1 described below in the Example section. It is a backscattered electron image examined at a magnification of 1000× with a scanning electron microscope (SEM). In FIG. 2, the principal phase is shown in gray and the R-rich phases are shown in white.

A magnet material alloy of the present invention is an R-T-B-based magnet material alloy and includes an $R_2T_{14}B$ phase which is a principal phase and R-rich phases which are phases enriched with the R. The principal phase has primary dendrite arms and secondary dendrite arms diverging from the primary dendrite arms. Regions where the secondary dendrite arms have been formed constitute a volume fraction of 2 to 60% of the alloy.

In FIG. 2, the areas surrounded by solid lines show part of the primary dendrite arms and the area surrounded by a dashed line shows part of the regions where secondary dendrite arms have been formed. In the magnet material alloy shown in FIG. 2, primary dendrite arms (trunks) composed of the principal phase have been formed and secondary dendrite arms (branches) have been formed in such a manner as to diverge from the primary dendrite arms (trunks). As shown in FIG. 2, the regions where the secondary dendrite arms have been formed are constituted by a plurality of secondary dendrite arms composed of the principal phase and R-rich phases formed in spaces between the secondary dendrite arms.

In such regions where secondary dendrite arms have been formed, the R-rich phases therein are present with very small inter-R-rich phase spacings, and therefore it is possible to refine the microstructure of the magnet material alloy. In production of sintered magnets using the magnet material alloy in which secondary dendrite arms have been formed, the alloy is pulverized, in the pulverizing step, into a fine powder with a particle size of not greater than 3 μm and forming is performed, in the forming step, using the fine powder with a particle size of not greater than 3 μm while inhibiting oxidation of the fine powder, forming failures, and the like. This facilitates breaking of exchange coupling between grains for the resulting sintered magnets because of the refined grains. Thus, it is possible to improve the anisotropy field Ha and reduce the local demagnetizing factor Neff, and consequently, it is possible to improve the coercive force Hc as specified in the formula (2).

Accordingly, with the magnet material alloy of the present invention, even in the case where the amount of heavy rare earth elements added to the magnet material alloy is reduced, a decrease in coercive force associated therewith can be inhibited, and therefore it is possible to ensure excellent coercive force in R-T-B-based sintered magnets.

If the volume fraction of regions where secondary dendrite arms have been formed is less than 2%, the microstructure of the magnet material alloy is not sufficiently refined, and therefore the coercive force in the sintered magnet will become insufficient. On the other hand, if the volume fraction of regions where secondary dendrite arms have been formed is greater than 60%, the fine powder to be obtained by pulverization in the pulverizing step of the sintered magnet production process has an increased surface area and therefore is inevitably oxidized. In addition, the crystal orientation is unfavorable for pressing in a magnetic field in the forming step, and therefore the coercive force in the sintered magnet will become insufficient. An explanation of how the volume fraction of regions where secondary dendrite arms have been formed is measured will be provided later.

Preferably, the magnet material alloy of the present invention has an inter-R-rich phase spacing of not greater than 3.0 μm in order to obtain a refined microstructure. As a result, the microstructure of the alloy as a whole, not only of the regions where secondary dendrite arms have been formed, will be in a state of being refined, and therefore the coercive force in the sintered magnet will be improved further.

In the meantime, the inter-R-rich phase spacing is preferably not less than 1.4 μm. The particle size of the fine powder to be obtained in the pulverizing step of the sintered magnet production process is about 2 μm at best, and it is difficult to obtain a fine powder having a particle size smaller than that. It is preferred that the inter-R-rich phase spacing is about the same as the particle size of the fine powder to be obtained in the pulverizing step. If the inter-R-rich phase spacing is less than 1.4 μm, it is too small with respect to the lower limit of 2 μm of the particle size of the fine powder to be obtained. In such a case, part of the fine powder particles will have multiple magnetic domains by including R-rich phases (including more than one principal phase), and this results in a decreased coercive force of the sintered magnet. An explanation of how the inter-R-rich phase spacing is measured will be provided later.

It is to be noted that a magnet material alloy sometimes include chill crystals, which are fine equiaxed grains that may form in the vicinity of the surface that was in contact with the chill roll. If the formation of chill crystals occurs, the chill crystal portions form an extremely fine powder in the pulverizing step in the sintered magnet production process, which results in a non-uniform particle size distribution of the fine powder and thus degradation of magnetic properties. In order to prevent the problem, in the magnet material alloy of the present invention, the volume fraction of chill crystals is preferably at most 1%, and more preferably the volume fraction of chill crystals is 0%, i.e., no chill crystals are included. An explanation of how the volume fraction of chill crystals is measured will be provided later.

In the magnet material alloy of the present invention, the secondary dendrite arm spacing is preferably 0.5 to 2.0 μm. When the secondary dendrite arm spacing is not greater than 2.0 μm, the coercive force in the sintered magnet will be improved further because of the refinement of the regions where secondary dendrite arms have been formed. In the meantime, if the secondary dendrite arm spacing is less than 0.5 μm, the degree of refinement of the regions where secondary dendrite arms have been formed is too great, and as a result, oxidation of the fine powder may occur in the pulverizing step or the crystal orientation may be unfavorable for the forming step, in the sintered magnet production process. An explanation of how the secondary dendrite arm spacing is measured will be provided later.

In the magnet material alloy of the present invention, the R-rich phases preferably have an ellipsoid aspect ratio of not greater than 0.5. As used herein, the ellipsoid aspect ratio of R-rich phase is an index associated with the shape, particularly the thickness (width), of an R-rich phase. An explanation of how it is measured will be provided later. The ellipsoid aspect ratio r of R-rich phase satisfies the relationship $0<r\leq 1$ based on its definition. The closer the value is to 1, the closer the shape of the R-rich phase is to a true circle or a regular polygon, and the closer the value is to 0, the thinner the shape of the R-rich phase is (the width is narrower).

When the ellipsoid aspect ratio of R-rich phase is not greater than 0.5, thin (narrow width) R-rich phases are formed in spaces between secondary dendrite arms, and thus the microstructure is placed in a state of being refined. As a result, the coercive force in the sintered magnet is improved further. The lower limit of the ellipsoid aspect ratio r of R-rich phase is expressed as $0<r$ based on its definition.

2. Measurement Method

In the present invention, the volume fraction of regions where secondary dendrite arms have been formed, the inter-R-rich phase spacing, the secondary dendrite arm spacing, and the ellipsoid aspect ratio of R-rich phase, as described above, are measured using images taken with a scanning electron microscope. Furthermore, in the present invention, the volume fraction of chill crystals is measured using an image taken with a polarizing microscope.

In the present invention, specimens to be subjected to photographing with a scanning electron microscope are prepared by the following procedures (a) to (c). In the present invention, specimens to be subjected to photographing with a polarizing microscope are prepared by the following procedures (a) and (b).

(a) Ten pieces of magnet material alloy (alloy flakes) were taken and they are embedded in a thermosetting resin and fixed.

(b) Polishing is performed to expose the cross section along the thickness direction of each alloy flake fixed in the resin and place the cross section in a mirror surface condition.

(c) Carbon is deposited on the cross section of each alloy flake in a mirror surface condition.

[Volume Fraction of Regions where Secondary Dendrite Arms have been Formed]

In the present invention, the volume fraction of regions where secondary dendrite arms have been formed is measured by the following procedure.

(1) Using the specimens prepared by the above procedures (a) to (c), a backscattered electron image of a cross section of each alloy flake is taken at a magnification of 1000× with a scanning electron microscope. The backscattered electron image is taken in such a manner that, assuming that the cross section of the alloy flake is equally divided into three regions in the thickness direction, the region located in the center can be entirely included in the image.

(2) The image is fed into an image analyzer, and binarization based on the luminance to discern between the R-rich phases and the principal phase is performed for each of the ten taken images.

(3) For each of the ten binary images, secondary dendrite arms diverging from primary dendrite arms are extracted, so that the regions where secondary dendrite arms have been formed, which are constituted by secondary dendrite arms and the R-rich phases in the spaces therebetween, are distinguished.

(4) For each of the ten images, the area of the regions where secondary dendrite arms have been formed and the cross-sectional area of the alloy are calculated, and the area of the regions where secondary dendrite arms have been formed is divided by the cross sectional area of the alloy, whereby the area fraction (%) of secondary dendrite arms of the alloy flake is calculated.

(5) The area fractions of secondary dendrite arms of the ten alloy flakes are averaged, and the average value is designated as the volume fraction of secondary dendrite arms of the magnet material alloy because it can be assumed that each phase is uniformly distributed in the direction perpendicular to the cross section of each alloy flake.

The reason that the backscattered electron image of the central region among the three divided regions is to be taken as described in above (1) is as follows. The region close to the surface that contacted the chill roll during casting may include some portions in which the microstructure is excessively fine. On the other hand, the region close to the surface on the opposite side may include some portions in which the microstructure is excessively coarse. Such excessively fine portions and excessively coarse portions correspond to so-called statistical outliers. Thus, by obtaining the backscattered electron image of the central region among the three divided regions, it is possible to measure representative values excluding outliers for the volume fraction of regions where secondary dendrite arms have been formed. By the term "surface on the opposite side" as used herein is meant the surface located opposite from the surface that contacted the chill roll during casting (the naturally cooled surface).

[Inter-R-Rich Phase Spacing]

In the present invention, the inter-R-rich phase spacing is measured by the following procedure.

(1) Using the specimens prepared by the above procedures (a) to (c), a backscattered electron image of a cross section of each alloy flake is taken at a magnification of 1000× with a scanning electron microscope. The backscattered electron image is taken in such a manner that, assuming that the cross section of the alloy flake is equally divided into three regions in the thickness direction, the region located in the center can be entirely included in the image.

(2) The ten taken images are each fed into an image analyzer, and binarization based on the luminance to discern between the R-rich phases and the principal phase is performed on them.

(3) A line parallel to the surface that contacted the chill roll is drawn at a thickness center for each of the ten binary images, and the spacings between adjacent R-rich phases on the line are measured and the average value of them is designated as the inter-R-rich phase spacing of the alloy flake.

(4) The inter-R-rich phase spacings of the ten alloy flakes are averaged, and the average value is designated as the inter-R-rich phase spacing of the magnet material alloy.

The reason that the backscattered electron image of the central region among the three divided regions is to be taken as described in above (1) is the same as in the case of measuring the volume fraction of regions where secondary dendrite arms have been formed. By obtaining the backscattered electron image of the central region among the three divided regions, it is possible to measure representative values excluding outliers for the inter-R-rich phase spacing.

[Volume Fraction of Chill Crystals]

In the present invention, the volume fraction of chill crystals is measured by the following procedure.

(1) Using the specimens prepared by the above procedures (a) and (b), an image of a cross section of each alloy flake is taken at a magnification of 85× with a polarizing microscope.

(2) The taken ten images are each fed into an image analyzer, and the chill crystal portions are extracted based on the region of very fine equiaxed crystals.

(3) For each of the ten images in which chill crystal portions have been extracted, the area of the chill crystal portions and the cross-sectional area of the alloy are calculated, and the area of the chill crystal portions is divided by the cross sectional area of the alloy, whereby the area fraction (%) of chill crystals of the alloy flake is calculated.

(4) The area fractions of chill crystals of the ten alloy flakes are averaged, and the average value is designated as the volume fraction (%) of chill crystals of the magnet material alloy because it can be assumed that chill crystal portions and the remaining alloy portions are uniformly distributed in the direction perpendicular to the cross section of each alloy flake.

[Secondary Dendrite Arm Spacing]

In the present invention, the secondary dendrite arm spacing is measured by the following procedure.

(1) Using the specimens prepared by the above procedures (a) to (c), a backscattered electron image of a cross section of each alloy flake is taken at a magnification of 1000× with a scanning electron microscope. The backscattered electron image is taken in such a manner that, assuming that the cross section of the alloy flake is equally divided into three regions in the thickness direction, the region located in the center can be entirely included in the image.

(2) The ten taken images are each fed into an image analyzer, and binarization based on the luminance to discern between the R-rich phases and the principal phase is performed on them.

(3) For each of the ten binary images, secondary dendrite arms diverging from primary dendrite arms are extracted.

(4) A line perpendicular to the surface that contacted the chill roll during casting is drawn on a portion where secondary dendrite arms were observed in each image, and the secondary arm spacing was measured at 20 points thereon and the average value of them is designated as the secondary dendrite arm spacing of the alloy flake.

(5) The secondary dendrite arm spacings of the ten alloy flakes are averaged, and the average value is designated as the secondary dendrite arm spacing of the magnet material alloy.

The reason that the backscattered electron image of the central region among the three divided regions is to be taken as described in above (1) is the same as in the case of measuring the volume fraction of regions where secondary dendrite arms have been formed. By obtaining the backscattered electron image of the central region among the three divided regions, it is possible to measure representative values excluding outliers for the secondary dendrite arm spacing.

[Ellipsoid Aspect Ratio of R-Rich Phase]

Figure 3:
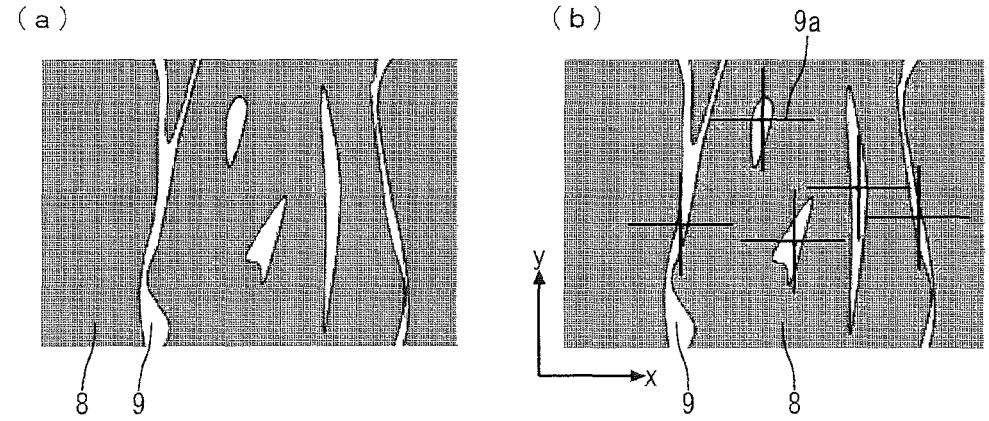
FIG. 3 is an illustration of a procedure for measuring the ellipsoid aspect ratio of R-rich phase, with FIG. 3(*a*) showing a binary backscattered electron image of a cross section of the alloy and FIG. 3(*b*) showing an image in which the positions of the center of gravity of R-rich phases have been located.

FIG. 3 is an illustration of a procedure for measuring the ellipsoid aspect ratio of R-rich phase, with FIG. 3(*a*) showing a binary backscattered electron image of a cross section of the alloy and FIG. 3(*b*) showing an image in which the positions of the center of gravity of R-rich phases have been located. In FIG. 3, the principal phase 8 is shown in dark gray and the R-rich phases 9 are shown in light gray.

In the present invention, the ellipsoid aspect ratio of R-rich phase is measured by the following procedure.

(1) Using the specimens prepared by the above procedures (a) to (c), a backscattered electron image of a cross section of each alloy flake is taken at a magnification of 1000× with a scanning electron microscope. The backscattered electron image is taken in such a manner that, assuming that the cross section of the alloy flake is equally divided into three regions in the thickness direction, the region located in the center can be entirely included in the image.

(2) The taken images are each fed into an image analyzer, and binarization based on the luminance to discern between the R-rich phases and the principal phase is performed on them, so as to obtain 10 images as shown in FIG. 3(*a*).

(3) For each of the ten binary images, the center of gravity 9*a* of each R-rich phase in the image is determined using image analysis software as shown in FIG. 3(*b*).

(4) For each R-rich phase in each image, a Cartesian coordinate system is set such that the origin is the center of gravity 9*a* of each R-rich phase, the X-axis is parallel to the surface that contacted the chill roll during casting, and the Y-axis is parallel to the thickness direction, and then, the second moment of area (Ix, Iy) is calculated for each of them using the above-mentioned image analysis software.

(5) For each R-rich phase in each image, the greater one of the second moments of area (Ix, Iy) is specified as a major axis, and the smaller one is specified as a minor axis, and then the ratio r of the minor axis to the major axis is calculated. Specifically, the ratio r is calculated by the following formula (3).

$$r=\mathrm{Min}\{Ix,Iy\}/\mathrm{Max}\{Ix,Iy\} \quad (3)$$

where Max {a, b} is a function for comparing input values a and b and outputting the greater one of them, and Min {a, b} is a function for comparing input values a and b and outputting the smaller one of them.

(6) For each image, the ratios r for all R-rich phases calculated by the above formula (3) are averaged, and the average value is designated as the ellipsoid aspect ratio of R-rich phase of the alloy flake.

(7) The ellipsoid aspect ratios of R-rich phase of the ten alloy flakes are averaged, and the average value is designated as the ellipsoid aspect ratio of the magnet material alloy.

The reason that the backscattered electron image of the central region among the three divided regions is to be taken as described in above (1) is the same as in the case of measuring the volume fraction of regions where secondary dendrite arms have been formed. By obtaining the backscattered electron image of the central region among the three divided regions, it is possible to measure representative values excluding outliers for the ellipsoid aspect ratio of R-rich phase.

3. R-T-B-Based Magnet Material Alloy Production Method of the Present Invention

The method for producing a magnet material alloy of the present invention is a method for producing an R-T-B-based magnet material alloy, the method including: casting a ribbon by supplying a molten R-T-B-based alloy to the outer peripheral surface of a chill roll and solidifying the molten alloy; and crushing the ribbon. The conditions for casting the ribbon is as follows: the average cooling rate on the chill roll is 2000 to 4500° C./second, and the temperature $T_I$ (° C.) of the ribbon at a position where it separates from the chill roll (hereinafter also simply referred to as "rapid cooling end temperature") satisfies the above formula (1).

In casting operations in general, not limited to casting of a magnet material alloy, formation of secondary dendrite arms is a technique sometimes used for the purpose of improving mechanical strength of the ingot. In such a case, secondary dendrite arms are typically formed by increasing the cooling rate for casting or adding heterogeneous nuclei to the molten alloy. For a magnet material alloy, addition of heterogeneous nuclei to the molten alloy is not appropriate from the standpoint of the influence on the mechanism by which magnetic properties are exhibited. For this reason, in the method for producing a magnet material alloy of the present invention, secondary dendrite arms are formed by increasing the cooling rate as described above.

Specifically, according to the method for producing a magnet material alloy of the present invention, ribbons are cast in such a manner that the average cooling rate on the chill roll is 2000 to 4500° C./second and the temperature $T_I$ (° C.) of the ribbon at the time when it separates from the chill roll (rapid cooling end temperature) satisfies the above formula (1). Consequently, the resulting magnet material alloy includes primary dendrite arms made of the principal phase and secondary dendrite arms formed therewith in such a manner that they diverge from the primary dendrite arms. In addition, the volume fraction of regions where secondary dendrite arms have been formed as described above is consequently 2 to 60%. By using such a magnet material alloy having a refined microstructure as a material for sintered magnets, it is possible to improve the coercive force of the sintered magnet as stated above.

If the average cooling rate on the chill roll is less than 2000° C./second, secondary dendrite arms is not formed in some cases. Even in the case where secondary dendrite arms have been formed, the volume fraction thereof is reduced and therefore refinement of the microstructure cannot be achieved. On the other hand, if the average cooling rate is higher than 4500° C./second, the volume fraction of regions where secondary dendrite arms have been formed becomes excessively large and therefore the microstructure becomes excessively refined.

Also, secondary dendrite arms may not be formed in the case where the rapid cooling end temperature $T_I$ is increased so that the difference between the melting point $T_M$ of the alloy and the rapid cooling end temperature $T_I$ falls below 400° C. and does not satisfy the condition specified by the above formula (1). Even if secondary dendrite arms have been formed, the volume fraction thereof is reduced and therefore refinement of the microstructure cannot be achieved. In the meantime, if the rapid cooling end temperature $T_I$ is decreased so that the difference between the melting point $T_M$ of the alloy and the rapid cooling end temperature $T_I$ exceeds 600° C. and does not satisfy the condition specified by the above formula (1), the volume fraction of regions where secondary dendrite arms have been formed becomes excessively large and therefore the microstructure becomes excessively refined.

In the present invention, the average cooling rate $V_T$ (° C./second) on the chill roll is calculated by the following formula (4).

$$V_T=(T_0-T_I)\times V_C/S \tag{4}$$

where $T_0$ is a temperature (° C.) of the molten alloy at a position immediately before it contacts the chill roll, $T_I$ is a temperature (° C.) of the ribbon at a position where it separates from the chill roll (see dashed arrow in FIG. 1), $V_C$ is a circumferential speed (mm/s) of the chill roll, and S is a length (mm) of contact between the molten alloy (ribbon) and the chill roll.

Figure 1:
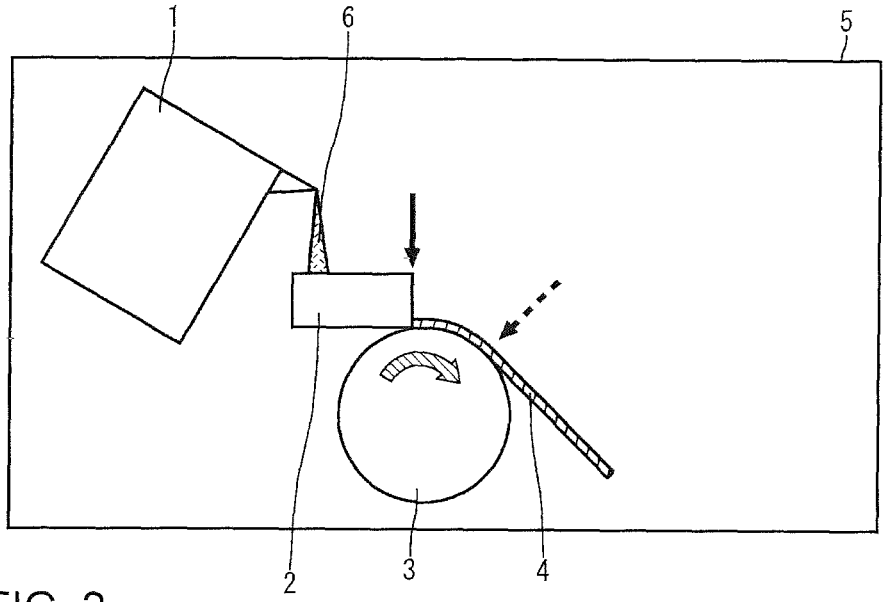
FIG. 1 is a schematic diagram of a casting apparatus that is used for casting of ribbons using a strip casting method.

In the case where the casting apparatus shown in FIG. 1 is used, the temperature $T_I$ (° C.) of the ribbon at a position where it separates from the chill roll may be determined by measuring, using a radiation pyrometer, the temperature of the naturally cooled surface of the ribbon at a position where it separates from the chill roll. The temperature $T_0$ of the molten alloy at a position immediately before it contacts the chill roll may be determined by measuring, using a radiation pyrometer, the temperature of the molten alloy at a rear end of the tundish (see solid arrow).

EXAMPLES

To verify the advantages of the magnet material alloy of the present invention and the method for producing the same, the following test was conducted.

[Test Method]

In this test, a thin ribbon was cast from a molten R-T-B-based alloy by the above-mentioned procedures (A) to (C) using the casting apparatus shown in FIG. 1. The cast ribbon was crushed into alloy flakes at a stage subsequent to the chill roll. The alloy flakes were cooled to room temperature for about 8 hours, thereby producing a magnet material alloy. In the casting of the ribbon, the amount of the molten alloy to be poured and the rotational speed of the chill roll were adjusted so that the cast ribbon had a thickness of about 0.3 mm. The condition of the atmosphere was an inert gaseous atmosphere of argon at a pressure of 200 torr.

In this test, the average cooling rate on the chill roll was adjusted by varying the surface temperature and the atmosphere condition. In the casting of the ribbon, the temperature of the naturally cooled surface of the ribbon (rapid cooling end temperature) at a position where it separates from the chill roll (see dashed arrow in FIG. 1) was measured using a radiation pyrometer. As the temperature of the molten alloy at a position immediately before it contacts the chill roll, the temperature of the molten alloy at a rear end of the tundish (see solid arrow in FIG. 1) was measured using a radiation pyrometer. Using these measured temperatures, the average cooling rate $V_T$ was calculated by the above formula (4).

In this test, the contents of the raw materials were varied to obtain magnet material alloys having chemical compositions A to C. The chemical compositions of the alloys are shown in Table 1. In addition, melting point temperatures of the alloys having the chemical compositions A to C are also shown in Table 1.

TABLE 1

| | Chemical Composition (Unit: atomic %, Balance is Fe) | | | | | | | Alloy Melting |
|---|---|---|---|---|---|---|---|---|
| Symbol | Nd | Pr | Dy | B | Al | Co | Cu | Point (° C.) |
| A | 10.7 | 2.2 | 1.3 | 6.2 | 0.5 | 1.0 | 0.1 | 1150 |
| B | 10.7 | 2.3 | 1.2 | 6.1 | 0.5 | 1.0 | 0.1 | 1150 |
| C | 11.0 | 2.3 | 1.0 | 6.0 | 0.5 | 1.0 | 0.1 | 1150 |

In Inventive Examples 1 to 4, the average cooling rate on the chill roll was adjusted to 2500 to 3400° C./second, and in Comparative Examples 1 to 3, the average cooling rate on the chill roll was adjusted to 1500 to 1900° C./second.

In both the inventive examples and comparative examples, measurements were made on the obtained magnet material alloys for the volume fraction of regions where secondary dendrite arms have been formed, the inter-R-rich phase spacing, the volume fraction of chill crystals, the secondary dendrite arm spacing, and the ellipsoid aspect ratio of R-rich phase, by the procedures described in the above "2. Measurement Method" section.

[Test Results]

Table 2 shows, for each experiment, the chemical compositions of the obtained magnet material alloys, and regarding the casting of the ribbon, the average cooling rate on the chill roll, the temperature of the ribbon at a position where it separates from the chill roll (rapid cooling end temperature), and the difference ($T_M$–$T_I$) between the melting point $T_M$ of the alloy and the rapid cooling end temperature $T_I$. In addition, Table 2 shows the volume fraction of regions where secondary dendrite arms have been formed, the secondary dendrite arm spacing, the inter-R-rich phase spacing, the ellipsoid aspect ratio of R-rich phase, and the volume fraction of chill crystals, of the magnet material alloy obtained in each experiment. In Table 2, the symbol "-" in the column of volume fraction of regions where secondary dendrite arms have been formed and the column of secondary dendrite arm spacing indicates that no secondary dendrite arms were observed (formed) in the obtained magnet material alloy.

In Comparative Examples 1 to 3, the average cooling rate on the chill roll was less than 2000° C./second, and in some experiments, secondary dendrite arms were not formed in the obtained magnet material alloy and even in experiments in which they were formed, the volume fraction of regions where they were formed was 1.5%. As a result, the microstructure was not sufficiently refined and the inter-R-rich phase spacing exceeded 3 μm. In addition, the shape of the R-rich phase was relatively thick (wide-width) with the ellipsoid aspect ratio thereof exceeding 0.5.

In contrast, in Inventive Examples 1 to 4, the average cooling rate on the chill roll was 2000° C./second or higher, and in all experiments, secondary dendrite arms were formed in the obtained magnet material alloy and the volume fraction of regions where they were formed was not less than 2%. In Inventive Examples 1 to 4, the difference between the melting point $T_M$ of the alloy and the rapid cooling end temperature $T_I$ was 400 to 600° C. These results demonstrate that: by casting a ribbon in such a manner that the average cooling rate on the chill roll is 2000° C./second or higher and the temperature $T_I$ (° C.) of the ribbon at the time when it separates from the chill roll satisfies the above formula (1), it is possible to form secondary dendrite arms such that the volume fraction of regions where they have been formed is at least 2%.

Furthermore, in Inventive Examples 1 to 4, secondary dendrite arms were formed, and as a result, the inter-R-rich phase spacing was not more than 3.0 μm and the alloy as a whole had a refined microstructure. In addition, the shape of the R-rich phase was elongated (narrow-width) with the ellipsoid aspect ratio thereof falling below 0.5, and the microstructure was refined.

Using the magnet material alloys obtained in the test as a material, sintered magnets were produced by the production process as described above. In the production of sintered magnets, pulverization was performed in the pulverizing step in such a manner that the resultant fine powder had a particle size about the same as the inter-R-rich phase spacing of the magnet material alloy, and in the forming step, forming was performed using the fine powder, while inhibiting oxidation, forming failures, and the like of the fine powder. Consequently, sintered magnets produced from the magnet material alloys of Comparative Examples 1 to 3 exhibited a decreased coercive force due to the reduced amount of heavy rare earth elements added, whereas sintered magnets produced from the magnet material alloys of Inventive Examples 1 to 4 were able to maintain a coercive force comparable to that in the case where the amount of heavy rare earth elements to be added is not reduced.

TABLE 2

| | | Casting conditions | | | Secondary dendrite arm | | R-rich phase | | Chill crystals |
|---|---|---|---|---|---|---|---|---|---|
| | | | Rapid cooling | | Volume | | | | Volume |
| Classification | Composition | Cooling rate (° C./sec) | end temperature (° C.) | $T_M - T_I$ (° C.) | fraction (%) | Spacing (μm) | Spacing (μm) | Ellipsoid aspect ratio | fraction (%) |
| Inv. Ex. 1 | A | 3400 | 650 | 500 | 28.5 | 0.7 | 2.12 | 0.32 | 0 |
| Inv. Ex. 2 | A | 3000 | 710 | 440 | 21.3 | 1.0 | 2.16 | 0.43 | 0 |
| Inv. Ex. 3 | B | 3000 | 600 | 550 | 29.2 | 1.2 | 1.76 | 0.34 | 0 |
| Inv. Ex. 4 | C | 2500 | 700 | 450 | 13.6 | 1.4 | 2.86 | 0.47 | 0 |
| Comp. Ex. 1 | A | 1500 | 770 | 380 | — | — | 3.22 | 0.75 | 0 |
| Comp. Ex. 2 | A | 1900 | 750 | 400 | 1.5 | 1.5 | 3.10 | 0.63 | 0 |
| Comp. Ex. 3 | A | 1800 | 760 | 390 | — | — | 3.20 | 0.69 | 0 |

These results demonstrate that: the magnet material alloy of the present invention is capable of ensuring a sufficient coercive force, i.e., capable of improving the coercive force of sintered magnets by having secondary dendrite arms formed therein and thus having a refined microstructure, even in the case where the amount of heavy rare earth elements added to the alloy is reduced.

When the magnet material alloy of the present invention is used as a material for sintered magnets, the coercive force can be improved, and therefore it is possible to ensure a sufficient coercive force of the sintered magnets even in the case where the amount of heavy rare earth elements added to the magnet material alloy is reduced. With the method for producing a magnet material alloy of the present invention, it is possible to produce the above-described magnet material alloy of the present invention. Consequently, the magnet material alloy of the present invention and the method for producing the same are capable of greatly contributing to improvement of the coercive force of sintered magnets and also greatly contributing to steady supply of sintered magnets by achieving the reduction of the amount of heavy rare earth elements to be added to the alloy.

REFERENCE SIGNS LIST

1: crucible, 2: tundish, 3: chill roll,
4: ingot, 5: chamber, 6: molten alloy, 8: principal phase,
9: R-rich phase, 9*a*: center of gravity of R-rich phase

What is claimed is:

1. An R-T-B-based magnet material alloy where R is at least one element selected from rare earth metals including Y, and T is one or more transition metals with Fe being an essential element, the R-T-B-based magnet material alloy comprising an $R_2T_{14}B$ phase which is a principal phase and R-rich phases which are phases enriched with the R, the principal phase having primary dendrite arms and secondary dendrite arms diverging from the primary dendrite arms, regions where the secondary dendrite arms have been formed constituting a volume fraction of 2 to 60% of the alloy, wherein an average spacing between adjacent R-rich phases is at most 3.0 μm.

2. The R-T-B-based magnet material alloy according to claim 1, wherein chill crystals constitute a volume fraction of at most 1% of the alloy.

3. The R-T-B-based magnet material alloy according to claim 2, wherein a secondary dendrite arm spacing is 0.5 to 2.0 μm.

4. The R-T-B-based magnet material alloy according to claim 3, wherein the R-rich phases have an ellipsoid aspect ratio of at most 0.5.

5. The R-T-B-based magnet material alloy according to claim 2, wherein the R-rich phases have an ellipsoid aspect ratio of at most 0.5.

6. The R-T-B-based magnet material alloy according to claim 1, wherein a secondary dendrite arm spacing is 0.5 to 2.0 μm.

7. The R-T-B-based magnet material alloy according to claim 6, wherein the R-rich phases have an ellipsoid aspect ratio of at most 0.5.

8. The R-T-B-based magnet material alloy according to claim 1, wherein the R-rich phases have an ellipsoid aspect ratio of at most 0.5.

* * * * *